United States Patent [19]

Bratt et al.

[11] 4,261,172

[45] Apr. 14, 1981

[54] SIX-CYLINDER DOUBLE-ACTING HOT GAS ENGINE

[75] Inventors: Jan C. Bratt, Malmö; Bengt-Ove M. Moodysson, Akarp, both of Sweden

[73] Assignee: Kommanditbolaget United Stirling (Sweden) AB & Co., Malmo, Sweden

[21] Appl. No.: 871,855

[22] Filed: Jan. 24, 1978

[51] Int. Cl.[3] ..... F02G 1/04

[52] U.S. Cl. ..... 60/525; 60/526

[58] Field of Search ..... 60/525, 716, 517, 526

[56] References Cited

U.S. PATENT DOCUMENTS

| | | | |
|---|---|---|---|
| 2,310,269 | 2/1943 | Waeber | 60/716 X |
| 2,657,553 | 11/1953 | Jonkers | 60/525 X |
| 3,802,198 | 4/1974 | Grossman et al. | 60/525 |
| 3,820,331 | 6/1974 | Reuchlein | 60/525 |
| 3,845,626 | 11/1974 | Berntell et al. | 60/525 |
| 3,991,457 | 11/1976 | Barton | 60/517 X |
| 4,069,670 | 1/1978 | Bratt et al. | 60/517 |
| 4,138,897 | 2/1979 | Ross | 60/525 X |

OTHER PUBLICATIONS

United Stirling Publication, *The Engine*, Jul. 1977.

*Primary Examiner*—Allen M. Ostrager
*Assistant Examiner*—Stephen F. Husar
*Attorney, Agent, or Firm*—Finnegan, Henderson, Farabow, Garrett & Dunner

[57] ABSTRACT

A compact six-cylinder, double-acting hot gas engine having a single central combustion chamber with the cylinders arranged in two groups of three and clustered around the combustion chamber axis at equal angular intervals. The engine has two crank shafts, one per group of three cylinders, rotating in the same direction and synchronized. Each crank shaft has three cranks with adjacent cranks angularly displaced 60 degrees. Each of the cranks of one crank shaft is directed oppositely to a respective one of the cranks of the other crank shaft.

7 Claims, 3 Drawing Figures

SIX-CYLINDER DOUBLE-ACTING HOT GAS ENGINE

Figure 1:
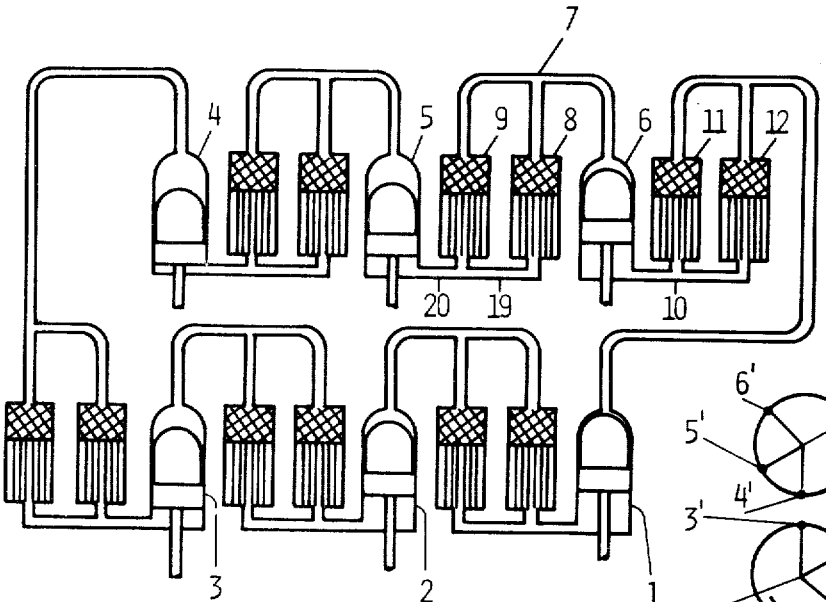

This invention relates to a six-cylinder double-acting hot gas engine of the kind (herein called the "kind defined") in which the cylinders are clustered around a major central axis of the engine, the axes of the cylinders are parallel to the major central axis, the radii from the central major axis to the axes of the cylinders are equally angularly distributed relative to one another, and there is a single central combustion chamber of which the axis coincides with the major central axis.

Each cylinder of a double-acting hot gas engine contains a reciprocating piston which transmits the force of the expanding gas on one side of the piston and which transmits a force compressing the gas at the other side of the piston. Due to a phase difference between the expansion and the compression, there is during each cycle a period in which the piston causes a braking torque to be exerted on the crank-shaft to which the piston is connected.

It has previously been proposed to provide a six-cylinder double-acting hot gas engine of the kind defined having three interconnected crank-shafts, in order to allow the use of cylinders and regenerators clustered around the major central axis and thus facilitate a simple construction of the heater head and combustion chamber.

However, the use of three crank-shafts each connected to two pistons does not avoid short periods during which one crank-shaft causes a negative moment, i.e. a braking torque, on the other two crank-shafts. Also the engine is as wide as it is long. This is disadvantageous if the engine is to be mounted in a vehicle, because in most vehicle applications the width should be kept within narrow limits.

The present invention is intended to facilitate the provision of an engine of the kind defined in which no negative torques will arise in the crank-shafts and which may have a smaller width while retaining the advantage of a single central symmetrical combustion chamber.

According to the invention a hot gas engine of the kind defined is characterised in that the six cylinders are arranged in two groups each of three cylinders, the middle cylinder is nearer than the other two cylinders in each group to the major central axis, the pistons in the cylinders of one of said groups are connected to a first crank-shaft, the pistons in the cylinders of the second of said groups are connected to a second crank-shaft, each of the crank-shafts has three cranks located at 60 degrees relative angular crank displacement for connection to the respective pistons, the two crank-shafts are constrained to rotate in synchronism with each other, and each of the cranks of the second crank-shaft extends in a direction opposite to that of a respective crank of the first crank-shaft.

The cylinders may be arranged in two parallel rows each of which constitutes one of said groups, and preferably the two groups are symmetrically placed on opposite sides of a plane which contains the major central axis.

A compact and neat construction can be obtained if a second plane which contains the major central axis and is perpendicular to the first-mentioned plane contains the axes of the two cylinders which are nearer to the major central axis.

In the advantageous construction there are six pairs of regenerator-cooler units of which each pair is connected by cold gas ducts to a respective one of the six cylinders, the regenerator-cooler units are disposed with their axes parallel to the major central axis and further from the major central axis than the axes of the cylinders, and those regenerator-cooler units connected by cold gas ducts to the said middle cylinders are nearer than the other regenerator-cooler units to the major central axis.

In a preferred engine each cylinder has at its top a manifold of arcuate form subtending an angle of 60° to the major central axis, and the six manifolds together substantially form a circle, each of the six pairs of regenerator-cooler units has at its top a manifold of arcuate form subtending an angle of 60° to the major central axis and these six manifolds together substantially form a circle, and each of the cylinder top manifolds is connected by a plurality of partially arcuate heater pipes to a respective one of the manifolds at the tops of the regnerator-cooler units.

Figure 2:
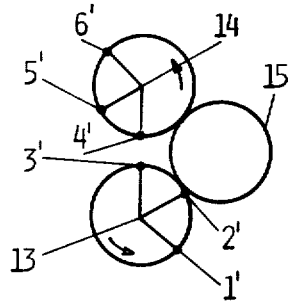
Figure 3:
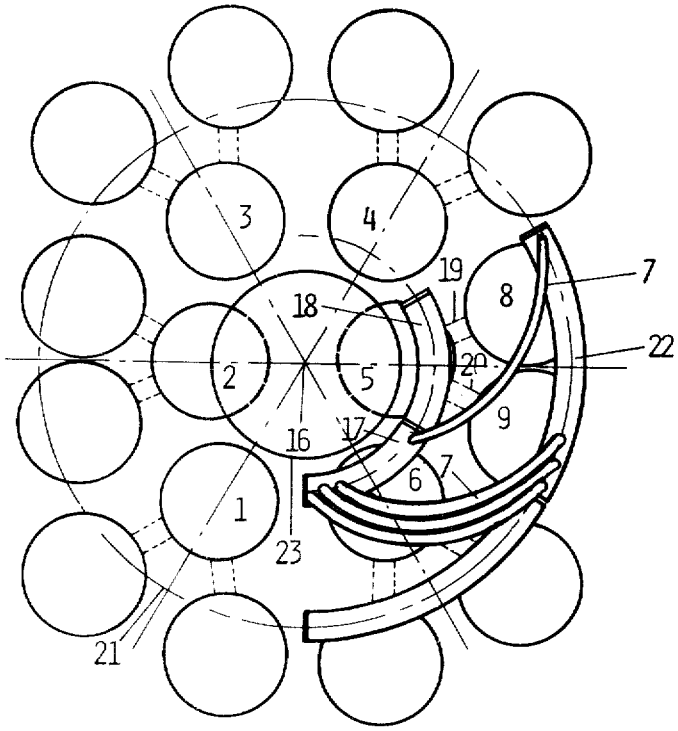

How the invention may be put into practice is described in more detail with reference to the accompanying schematic drawings, in which FIG. 1 shows the gas connections between the cylinders, FIG. 2 shows the relationship between the crank-shafts, and FIG. 3 shows the disposition of the cylinders and the regenerator-cooler units viewed from above.

FIG. 1 shows three cylinders 1 and 2 and 3 in one row and three other cylinders 4 and 5 and 6 in another row. In each cylinder is a reciprocating piston dividing the interior of the cylinder into two variable volume chambers. As an example it can be mentioned that the upper chamber of the cylinder 6 is connected to the lower chamber of the cylinder 5 via heater pipes 7 and two regenerator-cooler units 8 and 9, the units 8 and 9 being arranged in parallel. The lower chamber of the cylinder 6 is connected to the upper chamber of the cylinder 1 via cold gas ducts 10 and two regenerator-cooler units 11 and 12, the units 11 and 12 being in parallel.

FIG. 2 represents two crank-shafts 13 and 14 each having three cranks located at 60 degrees relative angular crank displacement. The pistons in the cylinders 1 and 2 and 3 are connected respectively to the three cranks 1', 2' and 3' of the crank-shaft 13. The pistons in the cylinders 4 and 5 and 6 are connected respectively to the three cranks 4', 5' and 6' of the crank-shaft 14. The two crank-shafts 13 and 14 are interconnected via a gear wheel 15 so that they are constrained to rotate in synchronism with each other. Each of the cranks 4', 5', 6' extends in a direction opposite to that of a respective crank 3', 2', 1'.

FIG. 3 shows, as viewed from above, a preferred relative disposition of the cylinders and regenerator-cooler units.

The cylinders 1 to 6 are clustered around a major central axis 16 of the engine, and the axes of the cylinders are parallel to the central axis 16. The radii from the central axis 16 to the axes of the six cylinders 1 to 6 are equally angularly distributed at angles of 60 degrees relative to one another. There is a single central combustion chamber which has a wall 23 and of which the axis coincides with the central axis 16. Each cylinder top is provided with a manifold to which are connected the heater pipes 7 respective to that cylinder. In FIG. 3 are shown only the manifolds 17 and 18 of the cylinders 6 and 5 respectively. As viewed in FIG. 3 the manifold 17 overlaps the inner part of the cylinder 6, whereas the manifold 18 overlaps the outer part of the cylinder 5. Due to the symmetric design of the engine the six manifolds of the six cylinders together substantially form a circle or complete ring.

The three cylinders 1, 2, and 3 form a group in which the middle cylinder 2 is nearer than the other two cylinders 1 and 3 in the group to the central axis 16, and likwise the middle cylinder 5 of the group of cylinders 4, 5, and 6 is nearer to the axis 16 than the cylinders 4 and 6.

Like the regenerator-cooler units connected to the lower chamber of the middle cylinder 2, the regenerator-cooler units 8 and 9 connected to the lower chamber of the middle cylinder 5 via cold gas ducts 19 and 20 have their axes located at a distance inwardly from an imaginary circle 21 centred on the central axis 16. The axes of the regenerator-cooler units connected to the lower chambers of the respective cylinders 1, 3, 4, and 6 are located at a distance outwardly from the circle 21. The inward distance from the circle 21 to the axes of regenerator-cooler units connected to the middle cylinders 2 and 5 is equal to the outward distance between the imaginary circle 21 and the axes of the regenerator-cooler units connected via cold gas ducts to the outer cylinders 1, 3, 4 and 6 of the engine. Each pair of regenerator-cooler units is provided with a manifold forming a 60 degrees ring segment following said imaginary circle 21. In FIG. 3 the manifold 22 of the units 8 and 9 is shown, and it overlaps the outer parts of the units 8 and 9. The manifolds (not shown) of the units connected to the outer cylinders 1, 3, 4 and 6 overlap the inner parts of the respective units.

It will be understood that the heater pipes 7 of the engine and the manifolds 17 and 18 may form six segments of identical shape and resistance against inner and outer gas flow, and are arranged in the single rotation-symmetrical combustion chamber having the wall 23. It will be readily understood that the engine according to the invention can be of compact design regarding the width of the engine.

It would be possible to place the cylinders 2 and 5 nearer to the central axis 16, and/or to place the cylinders 1, 3, 4 and 6 further from the central axis 16, so that the cylinders are arranged in two parallel rows each of which constitutes one of said groups.

The cylinders 1, 2 and 3 of one group and the cylinders of the other group 4, 5 and 6 are placed so that the two groups are symmetrically placed on opposite sides of a plane which contains the major central axis, and a second plane which contains the major central axis and is perpendicular to the first-mentioned plane contains the axes of the two cylinders which are nearer to the major central axis.

As can be seen in FIG. 3, the heater pipes 7 are partially arcuate, and the manifolds 17, 18 and 22 are of arcuate form.

What we claim is:

1. A compact hot gas engine comprising:

(a) a central axi-symmetric combustion chamber the axis of which defines the major central axis of the engine;

(b) six interconnected cylinders clustered around the major axis, each of said cylinders housing a respective piston, the axes of said cylinders being parallel to the major axis and being equally angularly distributed about the major axis; and (c) first and second crankshafts having respective axes parallel to one another, said first and second crankshafts being constrained to rotate in synchronism with one another, and wherein said six cylinders are arranged in two groups each consisting of three cylinders in flow connection, the middle cylinder in each group being nearer than the other two cylinders in the group to the major central axis wherein the two groups are symmetrically placed on opposite sides of a first plane which contains the major central axis, and wherein the axes of said two cylinders nearest the major central axis define a second plane containing the major central axis and being perpendicular to said first plane; the pistons in the cylinders of one of said groups are connected to said first crankshaft; the pistons in the cylinders of the second of said groups are connected to said second crankshaft, each of the crankshafts having three cranks located at 60 degrees relative angular crank displacement between adjacent cranks for connection to the respective pistons; and each of the cranks of the second crankshaft extends in a direction opposite to that of a respective crank of the first crankshaft, wherein under said arrangement of two groups, each of said first and second crankshafts is free from periods of negative moment due to the combined influence of the associated cylinders during operation of the engine.

2. A compact hot gas engine comprising:

(a) a central axi-symmetric combustion chamber the axis of which defines the major central axis of the engine, (b) six interconnected cylinders clustered around the major axis, each of said cylinders housing a respective piston, the axis of said cylinders being parallel to the major axis and being equally angularly distributed about the major axis;

(c) first and second crankshafts having respective axes parallel to one another, said first and second crankshafts being constrained to rotate in synchronism with one another, and wherein said six cylinders are arranged in two groups each consisting of three cylinders in flow connection, the middle cylinder in each group being nearer than the other two cylinders in the group to the major central axis wherein the two groups are symmetrically placed on opposite sides of a first plane which contains the major central axis, and wherein the axes of said two cylinders nearest the major central axis define a second plane containing the major central axis and being perpendicular to said first plane; the pistons in the cylinders of one of said groups are connected to said first crankshaft; the pistons in the cylinders of the second of said groups are connected to said second crankshaft, each of the crankshafts having three cranks located at 60 degrees relative angular crank displacement between adjacent cranks for connection to the respective pistons; and each of the cranks of the second crankshaft extends in a direction opposite to that of a respective crank of the first crankshaft, wherein under said arrangement of two groups, each of said first and second crankshafts is free from periods of negative moment due to the combined influence of the associated cylinders during operation of the engine; and (d) six pairs of regenerator-cooler units of which each pair is connected by cold gas ducts to a respective one of the six cylinders, the regenerator-cooler units being disposed with their axes parallel to the major central axis and farther from the major central axis than the axes of the cylinders, the regenerator-cooler units connected by cold ducts to the said middle cylinders being nearer than the other regenerator-cooler units to the major central axis.

3. A compact hot gas engine comprising:

(a) a central axi-symmetric combustion chamber the axis of which defines the major central axis of the engine;

(b) six interconnected cylinders clustered around the major axis, each of said cylinders housing a respective piston, the axes of said cylinders being parallel to the major axis and being equally angularly distributed about the major axis;

(c) first and second crankshafts having respective axes parallel to one another, said first and said second crankshafts being constrained to rotate in synchronism with one another, and wherein said six cylinders are arranged in two groups each consisting of three cylinders, the middle cylinder in each group being nearer than the other two cylinders in the group to the major central axis wherein the two groups are symmetrically placed on opposite sides of a first plane which contains the major central axis, and wherein the axes of said two cylinders nearest the major central axis define a second plane containing the major central axis and being perpendicular to said first plane; the pistons in the cylinders of one of said groups are connected to said first crankshaft; the pistons in the cylinders of the second of said groups are connected to said second crankshaft, each of the crankshafts having three cranks located at 60 degrees relative angular crank displacement between adjacent cranks for connection to the respective pistons; and each of the cranks of the second crankshaft extends in a direction opposite to that of a respective crank of the first crankshaft; and (d) six pairs of regenerator-cooler units of which each pair is connected by cold gas ducts to a respective one of the six cylinders, the regenerator-cooler units being disposed with their axes parallel to the major central axis and farther from the major central axis than the axes of the cylinders, the regenerator-cooler units connected by cold gas ducts to the said middle cylinders being nearer than the other regenerator-cooler units to the major central axis, and wherein the inward distance from an imaginary circle centered on the major central axis to the axes of the two pairs of said six pairs of regenerator-cooler units associated with said two cylinders nearest the major central axis is substantially equal to the outward distance between said imaginary circle and each regenerator-cooler axis of the remaining ones of said six regenerator-cooler unit pairs.

4. An engine according to claim 3, wherein the cylinders are arranged in two parallel rows each of which constitute one of said groups.

5. An engine according to claim 3, wherein each cylinder has at its top a cylinder top manifold of arcuate form and subtending an angle of 60 degrees to the major central axis, the six cylinder top manifolds together substantially forming a circle.

6. An engine according to claim 3, wherein each of the six pairs of regenerator-cooler units has at its top a regenerator-cooler top manifold of arcuate form and subtending an angle of 60 degrees to the major central axis, these six regenerator-cooler top manifolds together substantially forming a first circle.

7. An engine according to claim 6, further comprising six cylinder top manifolds positioned respectively at the top of said cylinders, each of said cylinder top manifolds being of arcuate form and subtending an angle of 60° to the major central axis, said six cylinder top manifolds together substantially forming a second circle positioned inside said first circle, wherein each of the cylinder top manifolds is connected by a plurality of partially arcuate heater pipes to a respective one of the regenerator-cooler top manifolds.

* * * * *